US008709236B2

(12) United States Patent
Serban et al.

(10) Patent No.: US 8,709,236 B2
(45) Date of Patent: Apr. 29, 2014

(54) PROCESS FOR REMOVING NITROGEN FROM FUEL STREAMS WITH CAPROLACTAMIUM IONIC LIQUIDS

(75) Inventors: Manuela Serban, Glenview, IL (US); Alan B. Levy, Randolph, NJ (US); Lihao Tang, Bridgewater, NJ (US); Alakananda Bhattacharyya, Glen Ellyn, IL (US)

(73) Assignee: UOP LLC, Des Plaines, IL (US)

( * ) Notice: Subject to any disclaimer, the term of this patent is extended or adjusted under 35 U.S.C. 154(b) by 243 days.

(21) Appl. No.: 13/429,596

(22) Filed: Mar. 26, 2012

(65) Prior Publication Data

US 2013/0248423 A1 Sep. 26, 2013

(51) Int. Cl.

| | |
|---|---|
| ***C10G 29/00*** | (2006.01) |
| ***C10G 29/20*** | (2006.01) |
| ***C10G 53/00*** | (2006.01) |
| ***C10G 53/02*** | (2006.01) |
| ***C10G 53/04*** | (2006.01) |

(52) U.S. Cl.

USPC ..... 208/254 R; 208/289; 208/290; 208/291; 208/177

(58) Field of Classification Search

CPC ..... C10G 17/00; C10G 29/00; C10G 29/20; C10G 29/205; C10G 31/00; C10G 31/08; C10G 51/00; C10G 53/00; C10G 53/02; C10G 53/04

USPC ..... 208/46, 49, 177, 187, 254 R, 289, 290, 208/291

See application file for complete search history.

(56) References Cited

U.S. PATENT DOCUMENTS 7,553,406 B2 * 6/2009 Wasserscheid et al. ..... 208/236

* cited by examiner

*Primary Examiner* — Walter D Griffin
*Assistant Examiner* — Derek Mueller
(74) *Attorney, Agent, or Firm* — Mark Goldberg

(57) ABSTRACT

A process for removing a nitrogen compound from a fuel feed, such as vacuum gas oil or diesel fuel, wherein the process includes contacting the fuel feed comprising the nitrogen compound with a fuel-immiscible caprolactamium ionic liquid to produce a fuel and fuel-immiscible caprolactamium ionic liquid mixture, and separating the mixture to produce a vacuum gas oil or a diesel effluent having a reduced nitrogen content relative to the vacuum gas oil or diesel feed. The invention provides an alternate use for caprolactamium ionic liquid that is produced in large quantities for the manufacture of caprolactam.

20 Claims, 2 Drawing Sheets

PROCESS FOR REMOVING NITROGEN FROM FUEL STREAMS WITH CAPROLACTAMIUM IONIC LIQUIDS

FIELD OF THE INVENTION

This invention relates to processes for reducing the nitrogen content of hydrocarbonaceous liquid fuels like vacuum gas oils (VGO) and diesel fuels. More particularly, the invention relates to removing nitrogen contaminants from VGO and diesel fuels using an ionic liquid that is an intermediate in the manufacture of caprolactam.

BACKGROUND OF THE INVENTION

VGO is a hydrocarbon fraction that may be converted into higher value hydrocarbon fractions such as diesel fuel, jet fuel, naphtha, gasoline, and other lower boiling fractions in refining processes such as hydrocracking and fluid catalytic cracking (FCC). However, VGO feed streams having higher amounts of nitrogen are more difficult to convert. For example, the degree of conversion, product yields, catalyst deactivation, and/or ability to meet product quality specifications may be adversely affected by the nitrogen content of the feed stream. It is known to reduce the nitrogen content of VGO by catalytic hydrogenation reactions such as in a hydrotreating process unit.

Similar issues are involved in the processing of diesel fuel. Diesel fuel contains sulfur-containing molecules that are well known pollutants. Therefore, there is an ever increasing need to provide diesel fuels that have ultra low sulfur content. A typical way of removing sulfur from diesel fuel is by catalytic hydrodesulfurization (HDS). It is, however, becoming more difficult to catalytically hydrodesulfurize diesel fuels to the lower level of sulfur now required. Since nitrogen content interferes with the effective removal of sulfur, it is necessary to remove nitrogen prior to removing the sulfur.

Various processes using ionic liquids to remove sulfur and nitrogen compounds from hydrocarbon fractions are also known. U.S. Pat. No. 7,001,504 B2 discloses a process for the removal of organosulfur compounds from hydrocarbon materials which includes contacting an ionic liquid with a hydrocarbon material to extract sulfur containing compounds into the ionic liquid. U.S. Pat. No. 7,553,406 B2 discloses a process for removing polarizable impurities from hydrocarbons and mixtures of hydrocarbons using ionic liquids as an extraction medium. U.S. Pat. No. 7,553,406 B2 also discloses that different ionic liquids show different extractive properties for different polarizable compounds.

There remains a need in the art for improved processes that enable the removal of compounds comprising nitrogen from vacuum gas oil (VGO) and diesel fuels as well as from other fuels.

Caprolactamium is an intermediate in the manufacture of caprolactam which in turn is used in the production of engineering polymers such as polyamide 6. Since millions of tons of caprolactam are used per year, there are correspondingly large amounts of the caprolactamium ionic liquid that are produced. While this ionic liquid has been known for many years, it is shown here to be effective in treatment of fuels, such as diesel fuel and vacuum gas oil.

SUMMARY OF THE INVENTION

In an embodiment, the invention is a process for removing a nitrogen compound from a vacuum gas oil comprising contacting the vacuum gas oil with a VGO-immiscible caprolactamium ionic liquid to produce a vacuum gas oil and VGO-immiscible caprolactamium ionic liquid mixture, and separating the mixture to produce a vacuum gas oil effluent and a VGO-immiscible caprolactamium ionic liquid effluent comprising the nitrogen compound. The ionic liquid used in the present invention is shown in the formula below that shows its prior art use in the production of caprolactam.

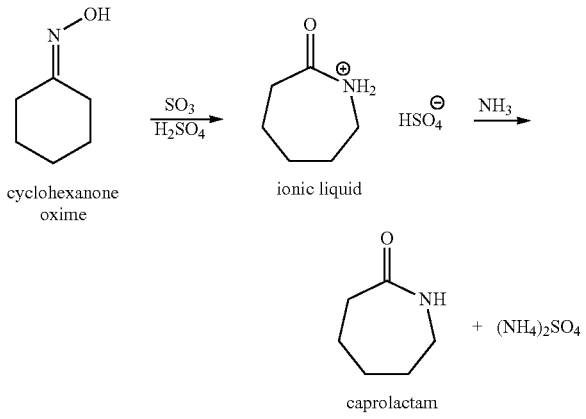

In another embodiment, the invention is a process for removing a nitrogen compound from a diesel fuel comprising contacting the diesel fuel with a diesel-immiscible caprolactamium ionic liquid to produce a diesel and diesel-immiscible caprolactamium ionic liquid mixture, and separating the mixture to produce a diesel fuel effluent and a diesel-immiscible caprolactamium ionic liquid effluent comprising the nitrogen compound.

DETAILED DESCRIPTION OF THE INVENTION

Figure 1:
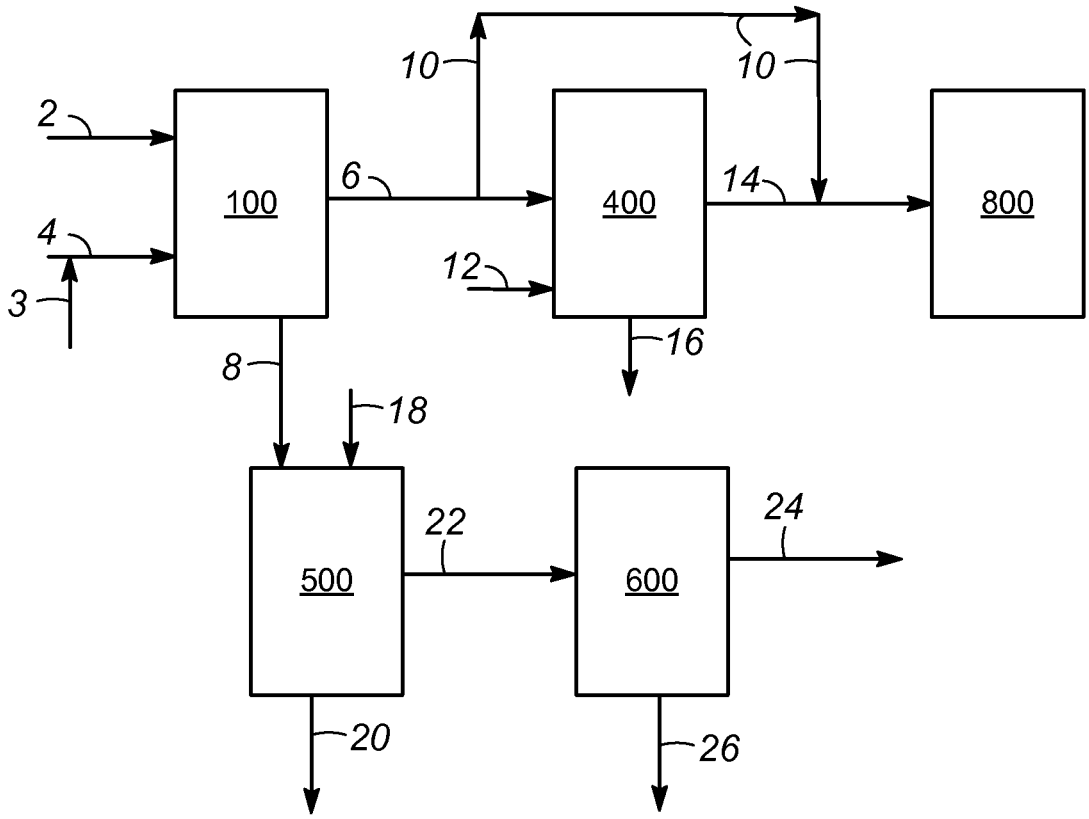
FIG. 1 is a simplified flow scheme illustrating various embodiments of the invention.

In general, the invention may be used to remove a nitrogen compound from a hydrocarbonaceous liquid fuel, more specifically a vacuum gas oil (VGO) hydrocarbon fraction or from diesel fuel through use of a caprolactamium ionic liquid.

The terms "vacuum gas oil", "VGO", "VGO phase" and similar terms relating to vacuum gas oil as used herein are to be interpreted broadly to receive not only their ordinary meanings as used by those skilled in the art of producing and converting such hydrocarbon fractions, but also in a broad manner to account for the application of our processes to hydrocarbon fractions exhibiting VGO-like characteristics. Thus, the terms encompass straight run VGO as may be produced in a crude fractionation section of an oil refinery, as well as, VGO product cuts, fractions, or streams that may be produced, for example, by coker, deasphalting, and visbreaking processing units, or which may be produced by blending various hydrocarbons.

In general, VGO comprises petroleum hydrocarbon components boiling in the range of from about 100° to about 720° C. In an embodiment, the VGO boils from about 250° to about 650° C. and has a density in the range of from about 0.87 to about 0.95 g/cm$^3$. In another embodiment, the VGO boils from about 95° to about 580° C.; and in a further embodiment, the VGO boils from about 300° to about 720° C. Generally, VGO may contain from about 100 to about 30,000 ppm-wt nitrogen; from about 1000 to about 50,000 ppm-wt sulfur; and from about 100 ppb-wt to about 2000 ppm-wt of metals. In an embodiment, the nitrogen content of the VGO ranges from about 200 to about 5000 ppm-wt. In another embodiment, the sulfur content of the VGO ranges from about 1000 to about 30,000 ppm-wt. The nitrogen content may be determined using ASTM method D4629-02, Trace Nitrogen in Liquid Petroleum Hydrocarbons by Syringe/Inlet Oxidative Combustion and Chemiluminescence Detection. The sulfur content may be determined using ASTM method D5453-00, Ultraviolet Fluorescence; and the metals content may be determined by UOP389-09, Trace Metals in Oils by Wet Ashing and ICP-OES. Unless otherwise noted, the analytical methods used herein such as ASTM D5453-00 and UOP389-09 are available from ASTM International, 100 Barr Harbor Drive, West Conshohocken, Pa., USA.

The terms "diesel", "diesel fuel", "diesel blends", "diesel phase" and similar terms relating to diesel may be used repeatedly in the description below and the appended claims. The term(s) should be interpreted broadly so that they receive not only their ordinary meanings as used by those skilled in the art such as a distillate fuel used in diesel engines, but in a broader manner to account for the broad application of our processes to fuels exhibiting diesel-like characteristics. Thus, the terms include, but are not limited to, straight run diesel, blended diesel, light cycle oil, light coker gas oil, heavy light cycle oils and the like.

Processes according to the invention remove a nitrogen compound from fuels such as vacuum gas oil and diesel fuel. That is, the invention removes at least one nitrogen compound. It is understood that the fuel will usually comprise a plurality of nitrogen compounds of different types in various amounts. Thus, the invention removes at least a portion of at least one type of nitrogen compound. The invention may remove the same or different amounts of each type of nitrogen compound, and some types of nitrogen compounds may not be removed. In an embodiment, the nitrogen content fuel is reduced by at least 40 wt %. In another embodiment, the nitrogen content is reduced by at least 75 wt %.

Ionic liquids are used to extract one or more nitrogen compounds from VGO. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms, such as nitrogen, phosphorous, sulfur, arsenic, boron, antimony, and aluminum, and the anions may be any inorganic, organic, or organometallic species.

Ionic liquids suitable for use in the instant invention are immiscible in the fuel being treated by the caprolactamium ionic liquids. As used herein the term "immiscible ionic liquid" means the ionic liquid immediate that is shown the following reaction equation:

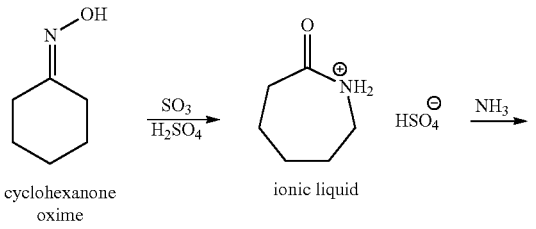

-continued

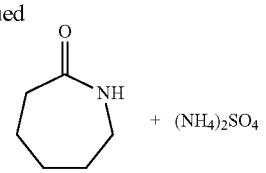

Consistent with common terms of art, the ionic liquid introduced to the nitrogen removal step may be referred to as a "lean caprolactamium ionic liquid" generally meaning a fuel-immiscible caprolactamium ionic liquid that is not saturated with one or more extracted nitrogen compounds. Lean caprolactamium ionic liquid may include one or both of fresh and regenerated caprolactamium ionic liquid and is suitable for accepting or extracting nitrogen from the fuel feed. Likewise, the caprolactamium ionic liquid effluent may be referred to as "rich caprolactamium ionic liquid", which generally means a fuel-immiscible caprolactamium ionic liquid effluent produced by a nitrogen removal step or process or otherwise including a greater amount of extracted nitrogen compounds than the amount of extracted nitrogen compounds included in the lean caprolactamium ionic liquid. A rich caprolactamium ionic liquid may require regeneration or dilution, e.g. with fresh caprolactamium ionic liquid, before recycling the rich caprolactamium ionic liquid to the same or another nitrogen removal step of the process.

In an embodiment, the invention is a process for removing nitrogen from vacuum gas oil (VGO), diesel fuel or other fuel comprising a contacting step and a separating step. In the contacting step, a fuel comprising a nitrogen compound and a fuel-immiscible caprolactamium ionic liquid are contacted or mixed. The contacting may facilitate transfer or extraction of the one or more nitrogen compounds from the fuel to the caprolactamium ionic liquid. Although a caprolactamium ionic liquid that is partially soluble in the fuel may facilitate transfer of the nitrogen compound from the fuel to the ionic liquid, partial solubility is not required. Insoluble fuel/caprolactamium ionic liquid mixtures may have sufficient interfacial surface area between the fuel and caprolactamium ionic liquid to be useful. In the separation step, the mixture of fuel and caprolactamium ionic liquid settles or forms two phases, a fuel phase and a caprolactamium ionic liquid phase, which are separated to produce a fuel-immiscible caprolactamium ionic liquid effluent and a vacuum gas oil effluent.

The process may be conducted in various equipment which are well known in the art and are suitable for batch or continuous operation. For example, in a small scale form of the invention, fuel and a fuel-immiscible caprolactamium ionic liquid may be mixed in a beaker, flask, or other vessel, e.g., by stirring, shaking, use of a mixer, or a magnetic stirrer. The mixing or agitation is stopped and the mixture forms a fuel phase and a caprolactamium ionic liquid phase which can be separated, for example, by decanting, centrifugation, or use of a pipette to produce a fuel effluent having a lower nitrogen content relative to the fuel. The process also produces a fuel-immiscible caprolactamium ionic liquid effluent comprising the one or more nitrogen compounds.

The contacting and separating steps may be repeated for example when the nitrogen content of the fuel effluent is to be reduced further to obtain a desired nitrogen level in the ultimate fuel product stream from the process. Each set, group, or pair of contacting and separating steps may be referred to as a nitrogen removal step. Thus, the invention encompasses single and multiple nitrogen removal steps. A nitrogen removal zone may be used to perform a nitrogen removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The nitrogen removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

FIG. 1 is a flow scheme illustrating various embodiments of the invention and some of the optional and/or alternate steps and apparatus encompassed by the invention. Fuel stream 2 and fuel-immiscible caprolactamium ionic liquid stream 4 are introduced to and contacted and separated in nitrogen removal zone 100 to produce fuel-immiscible caprolactamium ionic liquid effluent stream 8 and fuel effluent stream 6 as described above. The caprolactamium ionic liquid stream 4 may be comprised of fresh caprolactamium ionic liquid stream 3 and/or one or more caprolactamium ionic liquid streams which are recycled in the process as described below. In an embodiment, a portion or all of fuel effluent stream 6 is passed via conduit 10 to a hydrocarbon conversion zone 800. Hydrocarbon conversion zone 800 may, for example, comprise at least one of an FCC and a hydrocracking process which are well known in the art.

An optional fuel washing step may be used, for example, to recover caprolactamium ionic liquid that is entrained or otherwise remains in the fuel effluent stream by using water to wash or extract the ionic liquid from the fuel effluent. In this embodiment, a portion or all of fuel effluent stream 6 (as feed) and a water stream 12 (as solvent) are introduced to fuel washing zone 400. The fuel effluent and water streams introduced to fuel washing zone 400 are mixed and separated to produce a washed fuel stream 14 and a spent water stream 16, which comprises the caprolactamium ionic liquid. The fuel washing step may be conducted in a similar manner and with similar equipment as used to conduct other liquid-liquid wash and extraction operations as discussed above. Various fuel washing step equipment and conditions such as temperature, pressure, times, and solvent to feed ratio may be the same as or different from the nitrogen removal zone equipment and conditions. In general, the fuel washing step conditions will fall within the same ranges as given above for the nitrogen removal step conditions. A portion or all of the washed fuel stream 14 may be passed to hydrocarbon conversion zone 800.

An optional caprolactamium ionic liquid regeneration step may be used, for example, to regenerate the ionic liquid by removing the nitrogen compound from the ionic liquid, i.e. reducing the nitrogen content of the rich caprolactamium ionic liquid. In an embodiment, a portion or all of fuel-immiscible caprolactamium ionic liquid effluent stream 8 (as feed) comprising the nitrogen compound and a regeneration solvent stream 18 are introduced to ionic liquid regeneration zone 500. The fuel-immiscible caprolactamium ionic liquid effluent and regeneration solvent streams are mixed and separated to produce an extract stream 20 comprising the nitrogen compound, and a regenerated caprolactamium ionic liquid stream 22. The caprolactamium ionic liquid regeneration step may be conducted in a similar manner and with similar equipment as used to conduct other liquid-liquid wash and extraction operations as discussed above. Various caprolactamium ionic liquid regeneration step conditions such as temperature, pressure, times, and solvent to feed may be the same as or different from the nitrogen removal conditions. In general, the ionic liquid regeneration step conditions will fall within the same ranges as given above for the nitrogen removal step conditions.

In an embodiment, the regeneration solvent stream 18 comprises a hydrocarbon fraction lighter than the fuel and which is immiscible with the caprolactamium ionic liquid. The lighter hydrocarbon fraction may consist of a single hydrocarbon compound or may comprise a mixture of hydrocarbons. In an embodiment, the lighter hydrocarbon fraction comprises at least one of a naphtha, gasoline, diesel, light cycle oil (LCO), and light coker gas oil (LCGO) hydrocarbon fraction. The lighter hydrocarbon fraction may comprise straight run fractions and/or products from conversion processes such as hydrocracking, hydrotreating, fluid catalytic cracking (FCC), reforming, coking, and visbreaking. In this embodiment, extract stream 20 comprises the lighter hydrocarbon regeneration solvent and the nitrogen compound. In another embodiment, the regeneration solvent stream 18 comprises water and the ionic liquid regeneration step produces extract stream 20 comprising the nitrogen compound and regenerated fuel-immiscible caprolactamium ionic liquid 22 comprising water and the caprolactamium ionic liquid. In an embodiment wherein regeneration solvent stream 18 comprises water, a portion or all of spent water stream 16 may provide a portion or all of regeneration solvent stream 18. Regardless of whether regeneration solvent stream 18 comprises a lighter hydrocarbon fraction or water, a portion or all of regenerated VGO-immiscible caprolactamium ionic liquid stream 22 may be recycled to the nitrogen removal step via a conduit not shown consistent with other operating conditions of the process. For example, a constraint on the water content of the VGO-immiscible caprolactamium ionic liquid stream 4 or the caprolactamium ionic liquid/fuel mixture in nitrogen removal zone 100 may be met by controlling the proportion and water content of fresh and recycled ionic liquid streams.

Optional ionic liquid drying step is illustrated by drying zone 600. The ionic liquid drying step may be employed to reduce the water content of one or more of the streams comprising ionic liquid to control the water content of the nitrogen removal step as described above. In the embodiment of FIG. 1, a portion or all of regenerated fuel-immiscible caprolactamium ionic liquid stream 22 is introduced to drying zone 600. Although not shown, other streams comprising ionic liquid such as the fresh caprolactamium ionic liquid stream 3, fuel-immiscible caprolactamium ionic liquid effluent stream 8, and spent water stream 16, may also be dried in any combination in drying zone 600. To dry the caprolactamium ionic liquid stream or streams, water may be removed by one or more various well known methods including distillation, flash distillation, and using a dry inert gas to strip water. Generally, the drying temperature may range from about 100° C. to less than the decomposition temperature of the ionic liquid, usually less than about 300° C. The pressure may range from about 35 kPa(g) to about 250 kPa(g). The drying step produces a dried fuel-immiscible caprolactamium ionic liquid stream 24 and a drying zone water effluent stream 26. Although not illustrated, a portion or all of dried fuel-immiscible caprolactamium ionic liquid stream 24 may be recycled or passed to provide all or a portion of the fuel-immiscible caprolactamium ionic liquid introduced to nitrogen removal zone 100. A portion or all of drying zone water effluent stream 26 may be recycled or passed to provide all or a portion of the water introduced into VGO washing zone 400 and/or ionic liquid regeneration zone 500.

In another embodiment of the invention, the ionic liquid effluent stream 8 consisting of the spent caprolactamium IL containing the extracted nitrogen species from the hydrocarbonaceous liquid fuel is used directly without regeneration in the production of caprolactam.

Figure 2A:
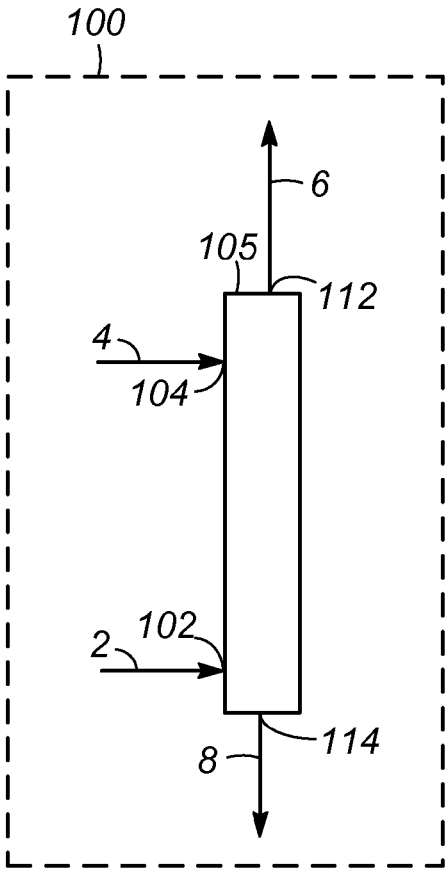
FIGS. 2A and 2B are simplified flow schemes illustrating different embodiments of an extraction zone of the invention.

FIG. 2A illustrates an embodiment of the invention which may be practiced in nitrogen removal or extraction zone 100 that comprises a multi-stage, counter-current extraction column 105 wherein fuel and fuel-immiscible caprolactamium ionic liquid are contacted and separated. The fuel feed stream 2 enters extraction column 105 through feed inlet 102 and lean caprolactamium ionic liquid stream 4 enters extraction column 105 through ionic liquid inlet 104. In the FIGURES, reference numerals of the streams and the lines or conduits in which they flow are the same. Fuel feed inlet 102 is located below ionic liquid inlet 104. The fuel effluent passes through fuel effluent outlet 112 in an upper portion of extraction column 105 to fuel effluent conduit 6. The fuel-immiscible caprolactamium ionic liquid effluent including the nitrogen compounds removed from the fuel feed passes through caprolactamium ionic liquid effluent outlet 114 in a lower portion of extraction column 105 to caprolactamium ionic liquid effluent conduit 8.

Figure 2B:
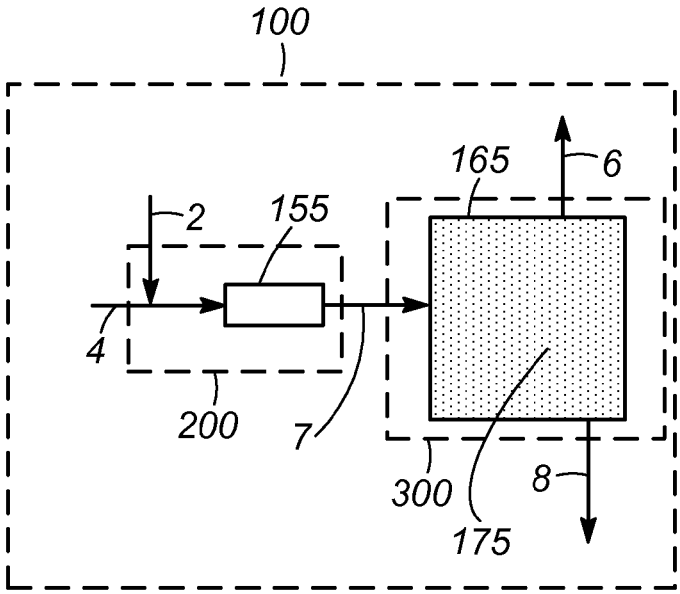

FIG. 2B illustrates another embodiment of nitrogen removal washing zone 100 that comprises a contacting zone 200 and a separation zone 300. In this embodiment, lean caprolactamium ionic liquid stream 4 and fuel feed stream 2 are introduced into the contacting zone 200 and mixed by introducing fuel feed stream 2 into the flowing lean caprolactamium ionic liquid stream 4 and passing the combined streams through static in-line mixer 155. Static in-line mixers are well known in the art and may include a conduit with fixed internals such as baffles, fins, and channels that mix the fluid as it flows through the conduit. In other embodiments, not illustrated, lean caprolactamium ionic liquid stream 4 may be introduced into fuel feed stream 2, or the lean caprolactamium ionic liquid stream 4 and fuel feed stream may be combined such as through a "Y" conduit. In another embodiment, lean caprolactamium ionic liquid stream 4 and fuel feed stream 2 are separately introduced into the static in-line mixer 155. In other embodiments, the streams may be mixed by any method well know in the art including stirred tank and blending operations. The mixture comprising fuel and caprolactamium ionic liquid is transferred to separation zone 300 via transfer conduit 7. Separation zone 300 comprises separation vessel 165 wherein the two phases are allowed to separate into a rich caprolactamium ionic liquid phase which is withdrawn from a lower portion of separation vessel 165 via caprolactamium ionic liquid effluent conduit 8 and the fuel phase is withdrawn from an upper portion of separation vessel 165 via fuel effluent conduit 6. Separation vessel 165 may comprise a boot, not illustrated, from which rich caprolactamium ionic liquid is withdrawn via conduit 8.

Separation vessel 165 may contain a solid media 175 and/or other coalescing devices which facilitate the phase separation. In other embodiments the separation zone 300 may comprise multiple vessels which may be arranged in series, parallel, or a combination thereof. The separation vessels may be of any shape and configuration to facilitate the separation, collection, and removal of the two phases. In a further embodiment, nitrogen removal zone 100 may include a single vessel wherein lean caprolactamium ionic liquid stream 4 and fuel feed stream 2 are mixed, then remain in the vessel to settle into the fuel effluent and rich caprolactamium ionic liquid phases. In an embodiment the process comprises at least two nitrogen removal steps. For example, the fuel effluent from one nitrogen removal step may be passed directly as the fuel feed to a second nitrogen removal step. In another embodiment, the fuel effluent from one nitrogen removal step may be treated or processed before being introduced as the fuel feed to the second nitrogen removal step. There is no requirement that each nitrogen removal zone comprises the same type of equipment. Different equipment and conditions may be used in different nitrogen removal zones.

The nitrogen removal step may be conducted under nitrogen removal conditions including temperatures and pressures sufficient to keep the fuel-immiscible caprolactamium ionic liquid and fuel feeds and effluents as liquids. For example, the nitrogen removal step temperature may range between about 10° C. and less than the decomposition temperature of the caprolactamium ionic liquid; and the pressure may range between about atmospheric pressure and about 700 kPa(g). When the fuel-immiscible ionic liquid comprises more than one caprolactamium ionic liquid component, the decomposition temperature of the caprolactamium ionic liquid is the lowest temperature at which any of the caprolactamium ionic liquid components decompose. The nitrogen removal step may be conducted at a uniform temperature and pressure or the contacting and separating steps of the nitrogen removal step may be operated at different temperatures and/or pressures. In an embodiment, the contacting step is conducted at a first temperature, and the separating step is conducted at a temperature at least 5° C. lower than the first temperature. In a non limiting example, the first temperature is about 80° C. Such temperature differences may facilitate separation of the fuel and caprolactamium ionic liquid phases.

The above and other nitrogen removal step conditions such as the contacting or mixing time, the separation or settling time, and the ratio of fuel feed to fuel-immiscible caprolactamium ionic liquid (lean caprolactamium ionic liquid) may vary greatly based, for example, on the specific caprolactamium ionic liquid or liquids employed, the nature of the fuel feed (straight run or previously processed), the nitrogen content of the fuel feed, the degree of nitrogen removal required, the number of nitrogen removal steps employed, and the specific equipment used. In general it is expected that contacting time may range from less than one minute to about two hours; settling time may range from about one minute to about eight hours; and the weight ratio of fuel feed to lean caprolactamium ionic liquid introduced to the nitrogen removal step may range from 1:10,000 to 10,000:1. In an embodiment, the weight ratio of fuel feed to lean caprolactamium ionic liquid may range from about 1:1,000 to about 1,000:1; and the weight ratio of fuel feed to lean caprolactamium ionic liquid may range from about 1:100 to about 100:1. In an embodiment the weight of VGO feed is greater than the weight of caprolactamium ionic liquid introduced to the nitrogen removal step.

In an embodiment, a single nitrogen removal step reduces the nitrogen content of the fuel by more than about 40 wt %. In another embodiment, more than about 50% of the nitrogen by weight is extracted or removed from the fuel feed 2 in a single nitrogen removal step; and more than about 60% of the nitrogen by weight may be extracted or removed from the fuel feed in a single nitrogen removal step. As discussed herein the invention encompasses multiple nitrogen removal steps to provide the desired amount of nitrogen removal. The degree of phase separation between the fuel and caprolactamium ionic liquid phases is another factor to consider as it affects recovery of the caprolactamium ionic liquid and fuel. The degree of nitrogen removed and the recovery of the fuel and caprolactamium ionic liquid may be affected differently by the nature of the fuel feed, the variations in the specific caprolactamium ionic liquid or liquids, the equipment, and the nitrogen removal conditions such as those discussed above.

The amount of water present in the fuel/fuel-immiscible caprolactamium ionic liquid mixture during the nitrogen removal step may also affect the amount of nitrogen removed and/or the degree of phase separation, i.e., recovery of the fuel and caprolactamium ionic liquid. In an embodiment, the fuel/fuel-immiscible caprolactamium ionic liquid mixture has a water content of less than about 10% relative to the weight of the caprolactamium ionic liquid. In another embodiment, the water content of the fuel/fuel-immiscible caprolactamium ionic liquid mixture is less than about 5% relative to the weight of the caprolactamium ionic liquid; and the water content of the fuel/fuel-immiscible caprolactamium ionic liquid mixture may be less than about 2% relative to the weight of the ionic liquid. In a further embodiment, the fuel/fuel-immiscible caprolactamium ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving nitrogen removal, washing, and regeneration zones may pass through ancillary equipment such as heat exchanges within the zones. Streams, including recycle streams, introduced to washing or extraction zones may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. Examples include: various streams comprising ionic liquid and water may be dried and/or passed to other zones to provide all or a portion of the water and/or ionic liquid required by the destination zone. The various process steps may be operated continuously and/or intermittently as needed for a given embodiment e.g. based on the quantities and properties of the streams to be processed in such steps. As discussed above the invention encompasses multiple nitrogen removal steps, which may be performed in parallel, sequentially, or a combination thereof. Multiple nitrogen removal steps may be performed within the same nitrogen removal zone and/or multiple nitrogen removal zones may be employed with or without intervening washing, regeneration and/or drying zones.

EXAMPLE

The example is presented to further illustrate some aspects and benefits of the invention and is not to be considered as limiting the scope of the invention. Two extraction experiments were done to investigate whether the caprolactamium IL is efficient at extracting the nitrogen species from HT (hydrotreated) VGO and diesel blend feeds. The samples were mixed for 30 minutes at 60° C. with a weight ratio of 0.5:1=IL:feed. The layers were separated by decantation and the cross-contamination (IL in feed) has been determined via liquid chromatography $SO_4^{2-}$ anion analysis of the HT VGO and diesel phases.

| Feed/Ionic Liquid | Mixing T (° C.) | Nitrogen (ppm) | % Nitrogen Removed | Sulfur (%) | Cross-contamination (ppm IL in Feed) |
|---|---|---|---|---|---|
| HT VGO | — | 430 | — | 0.11 | — |
| HT VGO + caprolactamium ionic liquid | 60 | 180 | 58 | 0.13 | 312 |
| Diesel Blend | — | 650 | — | 1.7 | — |
| Diesel + caprolactamium ionic liquid | 60 | 155 | 76.2 | 1.67 | 343 |

It was found that the caprolactamium ionic liquid was effective in removing nitrogen compounds from the two fuel streams that were processed. The large quantities of caprolactamium ionic liquids that are made in the production of caprolactams can now have an additional useful function. The caprolactamium ionic liquids may be neutralized and thus turned into caprolactam which may be then purified for sale. The present invention provides an additional use for the caprolactamium ionic liquids which can be used in large scale treatment of hydro carbonaceous fuel streams. It is also contemplated that the caprolactamium ionic liquids that are used in the practice of the present invention, may be recycled, purified by removal of impurities that may be introduced from contact with the fuel stream and then used again in the production of caprolactam.

The invention claimed is:

1. A process for removing nitrogen compounds from a fuel comprising:

(a) contacting the fuel comprising nitrogen compounds with a fuel-immiscible caprolactamium ionic liquid to produce a mixture comprising the fuel and the fuel-immiscible caprolactamium ionic liquid; and (b) separating the mixture to produce a fuel effluent and a fuel-immiscible caprolactamium ionic liquid effluent, the fuel-immiscible caprolactamium ionic liquid effluent comprising the nitrogen compound.

2. The process of claim 1 wherein said fuel is a vacuum gas oil or a diesel fuel.

3. The process of claim 1 wherein said fuel effluent comprises at least 50% less of said nitrogen compounds than said fuel before being contacted with said caprolactamium ionic liquid.

4. The process of claim 1 wherein the fuel effluent comprises at least 70% less of said nitrogen compounds than said fuel before being contacted with said caprolactamium ionic liquid.

5. The process of claim 1 wherein the mixture further comprises water in an amount less than 10% relative to the amount of fuel-immiscible caprolactamium ionic liquid in the mixture on a weight basis.

6. The process of claim 1 wherein the ratio of the fuel to the fuel-immiscible caprolactamium ionic liquid in the mixture ranges from about 1:1000 to about 1000:1 on a weight basis.

7. The process of claim 1 wherein the contacting step is conducted at a first temperature and the separating step is conducted at a second temperature, the first temperature and the second temperature ranging from about 10° C. to less than the decomposition temperature of the fuel-immiscible caprolactamium ionic liquid.

8. The process of claim 7 wherein the second temperature is at least 5° C. less than the first temperature.

9. The process of claim 1 further comprising passing at least a portion of the fuel effluent to a hydrocarbon conversion process.

10. The process of claim 1 further comprising washing at least a portion of the fuel effluent with water to produce a washed fuel stream and a spent water stream.

11. The process of claim 10 further comprising passing at least a portion of the washed fuel effluent stream to a hydrocarbon conversion process.

12. The process of claim 1 further comprising contacting the fuel-immiscible caprolactamium ionic liquid effluent with a regeneration solvent and separating the fuel-immiscible caprolactamium ionic liquid effluent from the regeneration solvent to produce an extract stream comprising the nitrogen compound and a regenerated fuel-immiscible caprolactamium ionic liquid stream.

13. The process of claim 12 further comprising recycling at least a portion of the regenerated fuel-immiscible caprolactamium ionic liquid stream to the nitrogen compounds contacting step of claim 1(a).

14. The process of claim 12 wherein the regeneration solvent comprises a lighter hydrocarbon fraction relative to the fuel and the extract stream further comprises the lighter hydrocarbon fraction, the lighter hydrocarbon fraction being immiscible with the fuel-immiscible caprolactamium ionic liquid.

15. The process of claim 1 wherein the fuel effluent comprises fuel-immiscible caprolactamium ionic liquid, further comprising washing at least a portion of the fuel effluent with water to produce a washed vacuum gas oil or diesel fuel and a spent water stream, the spent water stream comprising the fuel-immiscible caprolactamium ionic liquid; wherein at least a portion of the spent water stream is at least a portion of the regeneration solvent.

16. The process of claim 15 further comprising drying at least a portion of at least one of the regenerated fuel-immiscible caprolactamium ionic liquid stream, and the spent water stream to produce a dried fuel-immiscible caprolactamium ionic liquid stream.

17. The process of claim 16 further comprising recycling at least a portion of the dried fuel-immiscible caprolactamium ionic liquid stream to the nitrogen compounds contacting step of claim 1(a).

18. The process of claim 1 wherein the fuel-immiscible caprolactamium ionic liquid effluent is purified and is then used in the production of caprolactam.

19. A process for removing nitrogen compounds from a fuel comprising:

(a) contacting the fuel comprising the nitrogen compounds with a fuel-immiscible caprolactamium ionic liquid to produce a mixture comprising the fuel, and the fuel-immiscible caprolactamium ionic liquid;

(b) separating the mixture to produce a fuel effluent and a fuel-immiscible caprolactamium ionic liquid effluent, the fuel-immiscible caprolactamium ionic liquid effluent comprising the nitrogen compound;

(c) washing at least a portion of the fuel effluent with water to produce a washed fuel stream and a spent water stream;

(d) contacting the fuel-immiscible caprolactamium ionic liquid effluent with a regeneration solvent and separating the fuel-immiscible caprolactamium ionic liquid effluent from the regeneration solvent to produce an extract stream comprising the nitrogen compound and a regenerated fuel-immiscible caprolactamium ionic liquid stream; and (e) drying at least a portion of at least one of the fuel-immiscible caprolactamium ionic liquid effluent; the spent water stream, and the regenerated fuel-immiscible caprolactamium ionic liquid stream to produce a dried fuel-immiscible caprolactamium ionic liquid stream.

20. The process of claim 19 further comprising recycling at least a portion of at least one of the fuel-immiscible caprolactamium ionic liquid effluent; the spent water stream, the regenerated fuel-immiscible caprolactamium ionic liquid stream, and the dried fuel-immiscible caprolactamium ionic liquid stream to the nitrogen compounds contacting step of step (a).

* * * * *